United States Patent [19]

Enderlin

[11] Patent Number: 4,907,310

[45] Date of Patent: Mar. 13, 1990

[54] INSTALLATION FOR THE CONTINUOUS PROCESSING OF AT LEAST ONE TEXTILE YARN

[75] Inventor: Robert Enderlin, Morschwiller-Le-Bas, France

[73] Assignee: Superba, S.A., Mulhouse Cedex, France

[21] Appl. No.: 251,703

[22] PCT Filed: Mar. 11, 1987

[86] PCT No.: PCT/FR87/00066

§ 371 Date: Aug. 25, 1988

§ 102(e) Date: Aug. 25, 1988

[87] PCT Pub. No.: WO87/05640

PCT Pub. Date: Sep. 24, 1987

[30] Foreign Application Priority Data

Mar. 14, 1986 [FR] France ..... 86 03791

[51] Int. Cl.[4] ..... D06M 13/34

[52] U.S. Cl. ..... 8/149.2; 68/5 D; 68/20; 34/1; 34/68; 34/90

[58] Field of Search ..... 34/1, 41, 60, 68, 69; 68/5 D, 5 E, 20; 8/149.2, 149.3

[56] References Cited

U.S. PATENT DOCUMENTS 4,104,019 8/1978 Smith ..... 8/2

FOREIGN PATENT DOCUMENTS 2311890 12/1976 France .
2577250 8/1986 France .
1583953 2/1981 United Kingdom .

*Primary Examiner*—Henry A. Bennet
*Assistant Examiner*—John Sollecito
*Attorney, Agent, or Firm*—Sandler & Greenblum

[57] ABSTRACT

Installation for the continuous treatment of at least one textile yarn comprising means for continuously winding at least one yarn picked up on a reel, a deposit head for depositing this yarn on a conveyor belt, at least one thermal treatment enclosure area through which the yarn passes resting freely on the conveyor belt and means for taking up the yarn on the conveyor belt for rewinding it, wherein the thermal treatment enclosure area comprises a yarn drying apparatus using microwave or high frequency treatment, and forced ventilation means across the yarn and the conveyor belt.

10 Claims, 3 Drawing Sheets

INSTALLATION FOR THE CONTINUOUS PROCESSING OF AT LEAST ONE TEXTILE YARN

Figure 1:
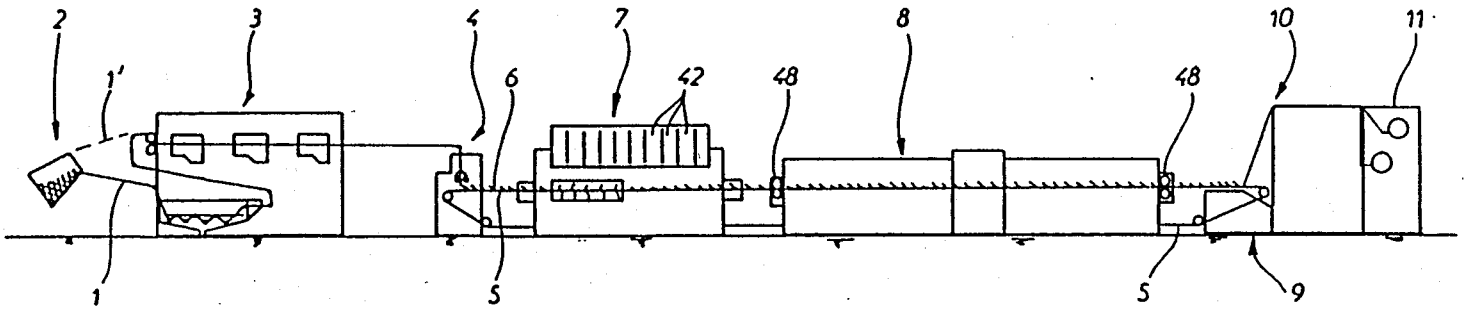

The present invention relates to an installation of the continuous treatment of at least one textile yarn, comprising means for continuously winding at least one yarn picked up on a reel, a deposit head for depositing this yarn on a gas permeable conveyor belt, at least one thermal treatment enclosure, through which the yarn passes resting freely on the said conveyor belt, and an apparatus for taking up the yarn on the conveyor belt for rewinding it, the said thermal treatment enclosure comprising a drying apparatus of the yarn by the micro-wave or high frequency treatment, provided with forced ventilation means across the deposit of the yarn and the conveyor belt.

The use of heating by dielectric loss for the thermal treatment of textile yarns and particularly for their drying makes it possible to achieve speeds of evaporation which cannot be obtained by traditional means. In fact, it heats at the same time all of the water absorbed in the different portions of the volume of the material, which produces an excellent uniformity of treatment and a low duration of drying of a material presented in the form of a mass of relatively dense yarns. Presently this mode of drying yarns in high frequency dryers is used (on the order of 15–13 MHz) in which the yarns are introduced in the forms of reels. However, as normal reels have a low permeability to the passage of the vapor, the water vaporized has difficulty evacuating and rises in pressure and temperature, heating the material itself. The more the material heats, the greater its dielectric loss factor and it absorbs thus yet further energy. One achieves in this manner a thermal burst of energy condition, contrary to the normal self regulation phenomenon with result from the diminution of the loss factor as a result of the progressive dimunition of moisture. This thermal burst of energy can lead to a melting together or localized carbonization of the yarn. It is very difficult to remedy it, other than by reducing the power and by forming reels of specially low density.

A solution to this problem is proposed in British application No. 1,583,953. It is an installation in which a continuous textile support, such as a fabric or group of parallel yarns, continuously passes through a printing fixation chamber. In this chamber, the support is subjected at the same time to a micro-wave heating and to a ventilation going through it. The combination of a relatively thin deposit of the yarns on the conveyor belt with a heating by dielectric loss makes it possible to assure an appropriate forced ventilation across the deposit of yarns and to eliminate the risk of thermal burst of energy, by virtue also of the fact that the density of the deposit of the yarns can be about 10 times less than that of the reels. One thus profits from the self-regulation of the drying peculiar to this principle of heating and one obtains at the output a uniform humidity of the yarn, which can be adjusted in an optimum manner in view of a normal take up rate. Yet the apparatus proposed produces a rapid drying during the thermal treatment, which does not make it possible to operate a thermal treatment in which the textile product must be maintained during a certain time in an atmosphere which is both hot and humid.

The present invention has as an aim to overcome this disadvantage, by virtue of installation which functions continuously.

To this end, the invention relates to an installation of the type indicated above, characterized in that the said thermal treatment enclosure comprises a fixation zone, provided with a tubular sheath surrounding the conveyor belt and the yarn deposited thereon, this sheath having a double wall made of a material permeable to the high frequency or micro-waves utilized and enclosing in this double wall a circuit of heating fluid, and a drying zone situated downstream of the fixation zone, the assembly constituted by the fixation zone and the drying zone being equipped with high frequency or micro-wave generator.

The deposit head is preferably a head depositing the yarn in the form of turns or in another repetitive geometry.

In the conventional high frequency dryers, the charge of the amount of water at the inlet and at the outlet of the HF applicator is variable with respect to the type of material to treat (cotton, wool, polyester, etc.) and an automatic correction to each change of lot is complicated to achieve and represents particularly a high investment. On the contrary, in an installation according to the invention, one can easily adjust the amount of water by bearing the velocity of deposit and of transport with respect to the blend and quality of the yarn. As a result, one eliminates the necessity of a rigorous control of the adaptation conditions of the impedence of the HF applicator.

Since this apparatus makes it possible to use a deposit of yarn of a relatively thin thickness, for example not exceeding 40 mm., is possible to perform the drying by means of micro-waves whose frequency is on the order of 2,450, MHz. In fact, the depth of penetration being inversely proportional to the frequency and to the losses, such high frequencies are not usable for heating reels of conventional size.

Preferably, the thermal treatment enclosure comprises at least one air inlet situated above the conveyor belt, at least one air outlet situated below this belt and connected to aspiration means, and deflectors positioned between the edges of the belt and the respective lateral walls of the enclosure in a manner so as to force the air across the belt.

In addition to the above elements and so as to allow for the use of the said elements in different treatment processes, the installation according to the invention can be completed by various treatment units positioned upstream or downstream of the thermal treatment enclosure. In particular, it can comprise at least one water extraction apparatus positioned along the path of the yarn upstream of the deposit head, this water extraction apparatus preferably being of the pneumatic expression type. The installation can also comprise at least one impregnation means of the yarn upstream of the water extraction apparatus. In a preferred embodiment, the installation comprises upstream of the deposit head and impregnation machine in which are gathered the impregnation means and the said water extraction apparatus. This impregnation machine can comprise a container containing a liquid bath through which extends the path of the yarn, for example for washing or dying the yarn. The installation can furthermore comprise a pressurized vapor thermal fixation chamber, through which the conveyor belt extends between the thermal treatment enclosure and the yarn take up apparatus.

According to another aspect resulting from the principles explained above, the present invention relates likewise to a continuous drying process of the textile yarns resting freely on a conveyor belt permeable to the gas, in which one circulates the said conveyor supporting the yarns across an enclosure positioned substantially at atmospheric pressure, one exposes the yarns to micro-waves causing a heating of the water contained in the yarns, and one simultaneously performs a forced ventilation across the yarns and the conveyor belt, characterized in that, in an initial zone of the path of the conveyor belt in the said enclosure, one locally suppresses the forced ventilation and one maintains a elevated level of humidity around the yarns by means of a heated sheath permeable to the micro-waves, surrounding the conveyor and the yarns supported thereby.

Figure 4:
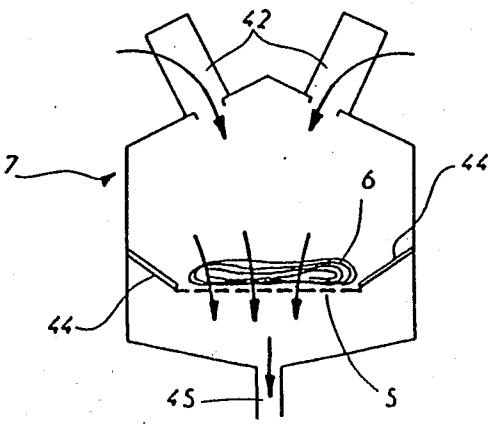
Figure 2:
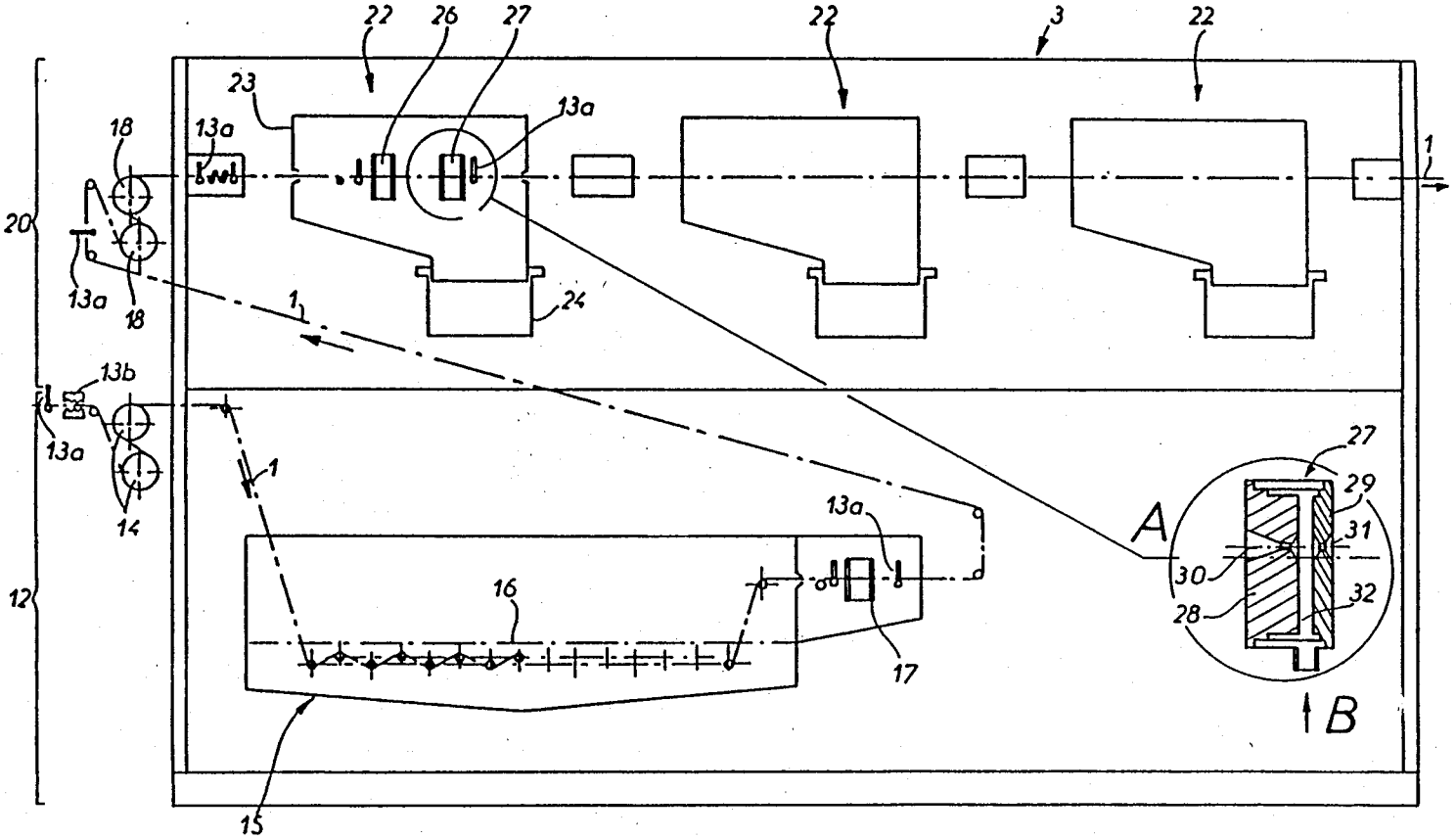
Figure 3:
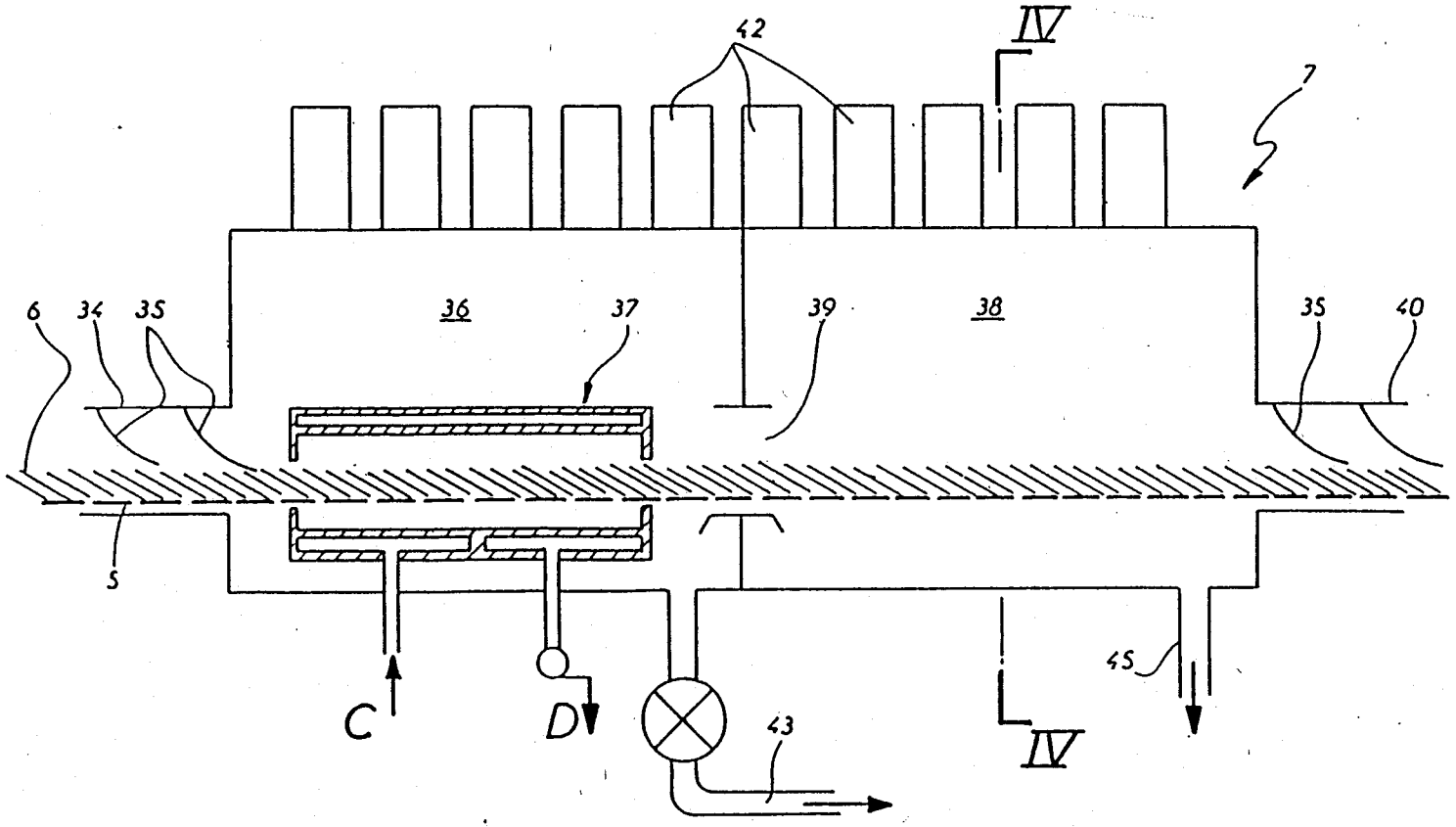

The present invention and its advantages will be better understood with the assistance of the description of one preferred embodiment of the installation, given below by way of example and with reference to the annexed drawings, in which:

FIG. 1 is a lateral schematic and partially cut away view of an installation comprising in particular an impregnation machine and a thermal treatment enclosure, FIG. 2 is a schematic view in longitudinal cross section of the impregnation machine, FIG. 3 is a schematic view in longitudinal cross section of the thermal treatment enclosure, and FIG. 4 is a schematic view in transverse cross section along line IV—IV of FIG. 3.

The installation shown totally and schematically in FIG. 1 is a treatment line of one or more textile yarns (1 in the description which follows, general reference will be made to a single yarn to simplify the description explanation). The installation is constituted by a series of units which are traversed by the yarn in the course of treatment and which include: a rack of reels 2 on which the yarn is continuously taken up; an impregnation machine 3 whose various functions will be explained below and in which the yarn circulates in the longitudinal direction; a deposit head 4 having as a function to deposit the yarn 1 on a conveyor belt 5 along a determined geometry, for example in the form of turns 6 which are layered towards the rear by resting on one another in a staggered manner; a thermotreatment enclosure 7, traversed by the conveyor belt 5; a thermofixation chamber 8, likewise traversed by the conveyor belt 5; a drive mechanism 9 for the conveyor belt 5; and an apparatus 10 for taking up the yarn on the conveyor belt, for rewinding it on the winding machine 11. Although it has not been shown, the installation naturally comprises feed elements furnishing the various fluids necessary for the treatment, as well as control elements which coordinate the operation of the different units.

In this installation, units 2, 4, 8, 9, 10 and 11 are well known and do not require particular description here. Likewise, the conveyor belt 5, which is perforated so as to be able to be traversed in particular by air and water vapor, forms a portion of a conveyor of the type currently utilized in the textile industry.

References will be made to FIG. 2 for the description of the impregnation machine 3. Along the path of yarn 1, this machine comprises successively in a first stage 12 a separation comb 13*a* for the case where one treats a plurality of parallel yarns, a brake 13*b* utilized in the case of a stop, drive pulleys 14 for yarn 1, a washing or dyeing container 15 containing a bath 16 through which circulates the yarn, and a water extraction apparatus 17 positioned at the outlet of container 15.

The yarn 1 then moved by another set of pulleys 18 towards a second stage 20 which essentially comprises 3 similar modules 22 positioned and in series on the path of the yarn. Each module 22 is adapted to perform a water extraction and if desired a preliminary impregnation of the yarn. To this end, it comprises an enclosure 23 provided with an inlet and an outlet for the yarn 1, as well as a liquid recovery container 24. This container encloses an impregnation apparatus 26 and a water extraction apparatus 27, of the pneumatic expression type, which is shown in longitudinal cross section in detail A of FIG. 2. It will be seen that this apparatus is of a particularly simple construction; it is formed of a container whose two opposed walls 28 and 29 are each bored with a orifice 30, 31 for the passage of the yarn. These orifice have a funnel shape at the inlet and at the outlet and each present a minimal diameter which is slightly greater than that of the yarn. To produce water extraction one introduces the compressed air along arrow B in a central conduit 32 communicating with the orifices 30 and 31. The air escaping at high velocity and with a high pressure drop around the yarn in two orifices takes away with it a substantial portion of the liquid contained in the yarn, which is taken into container 24. If one does not desire to perform a water extraction, it suffices to stop the arrival of compressed air, the yarn then being able to continue to circulate across the apparatus.

The impregnation apparatus 26 is constructed in a manner similar to the apparatus 27. Instead of injecting compressed air, one injects along arrow B a dyeing liquid or any other treatment liquid with which one desires to impregnate the yarn. This one can then directly have water extracted in the same module 22 or only in one of the following modules.

It must be noted that, if one does not utilize the first stage 12 of the impregnation machine 3, one can pass the yarn directly from the rack of reels 2 to the second stage 20, along the shortened path 1′ shown in dashed lines in FIG. 1.

The general shape of the thermal treatment container 7 is shown schematically by FIGS. 3 and 4. Along the length of the path of the conveyor belt 5 supporting the turns of yarn 6, this enclosure comprises: an inlet corridor 34 equipped with metallic valves 35 serving as wave traps; a fixation chamber 36 in which the conveyor belt and the turns of yarn are surrounded by a tubular sheath 37; a drying chamber 38 which communicates with the fixation chamber 36 by an opening 39; and an outlet corridor 40 equipped with metallic valves 35. A series of micro-wave generators 42 is distributed along the length of the upper wall of the two chambers 36 and 38 in a manner so as to expose to the micro-waves the turns of yarn 6. The micro-waves are confined within the enclosure 7 by the metallic walls of the enclosure and by the metallic valves 35. The preferred frequency for heating the water contained in the yarn is 2,450 MHZ. In a prototypic installation, it is anticipated to use 40 generators of 1.2 KW.

The sheath 37 is partially opened at the two ends and it comprises essentially a double walled tube made up of a micro-wave permeable material, for example, glass. In the annular space defined by the double wall, the vapor introduced along arrow C and evacuated along arrow D is circulated, to heat the sheath 37. As this sheath surrounds the conveyor belt 5 and the turns of yarn, the yarn is exposed in this sheath to a particularly hot and humid micro-climate. In fact, on the one hand, the yarn is not ventilated in this zone while being heated by the microwaves and, on the other hand, the humidity escaping from the yarn can not be condensed on the heated walls of the sheath 37, such that the atmosphere remains extremely humid in the sheath. In this manner, the yarn charged with humidity undergoes a homogeneous heating until a temperature on the order of 80°-100° C., favorable for example for the fixation of a coloring agent on the fibers.

The two chambers 36 and 38 are ventilated by air introduced at the top of the container, as is shown by the arrows of FIG. 4, across the micro-wave generators 42 so as to cool them. The air charged with humidity is evacuated from the fixation chamber 36 by an aspiration conduit 43. In the drying chamber 38, the air introduced from on top is forced across the deposit of yarn 6 and the conveyor belt 5, by virtue of deflectors 44 which block the space positioned between the conveyor belt 5 and the lateral walls of the container. The air is evacuated by an aspiration conduit 45.

The combination of the fixation chamber 36 and of the drying chamber 38 in a single enclosure 7 of micro-wave treatment makes it possible to effect a complex thermal treatment with a high economy with respect to the construction, the cumbersomeness and the consumption of energy. It allows furthermore for a rapid drying by virtue of the initial substantial heating of the products by the micro-waves or the high fequencies during the first portion of the treatment, where the humidity is maintained at an elevated level.

In an installation according to the invention, the thermofixation chamber 8 is optional. However, it is generally advantageous to integrate this chamber to the installation if there is sufficient space available. It can be taken out of service without affecting the operation of the rest of the installation. Such a chamber equipped with a (SAS) having rollers 48 at the inlet and outlet is well known in the art and requires no particular description.

A notable advantage of the insulation described above is its modular design offering multiple possibilities of use, by varied combinations of the following operations:

(a) Unwinding on the rack 2,
(b) Impregnation in the machine 3, in the container 15, and/or in the impregnation apparatus,
(c) Simple or multiple water extraction in the machine 3,
(d) Deposit by the head 4 on the conveyor 5,
(e) Drying by high frequency or micro-waves, with possible fixation, in the treatment enclosure 7,
(f) Pressure vaporization in chamber 8,
(g) Wind up of the dry yarn on the reel 11.

We indicate below several examples of treatment with the combination of corresponding operations.

Drying of a water-extracted yarn preliminarily in a centrifuge:

(a)+(d)+(e)+(g).

Drying of a yarn not preliminarily water-extracted:

(a)+(c)+(d)+(e)+(g).

Washing and drying, for example for yarns spun thickly;

(a)+(b)+(c)+(d)+(e)+(g).

Dyeing without pressure fixation:

(a)+(b)+(c)+(d)+(e)+(g).

Dyeing with pressure fixation:

(a)+(b)+(c)+(d)+(e)+(f)+(g).

In all cases, the water extraction can be modulated by using one or a plurality of pneumatic expression apparatus in machine 3, as well as by varying the pressure of compressed air. On the other hand, by adjusting the velocity of takeup of the yarn, one adjusts the load of water at the inlet of the thermotreatment container 7. By an adjustment of the velocity of the conveyor belt 5, one adjusts the density of the deposit of the yarn on the conveyor.

What is claimed is:

1. An installation for the continuous treatment of at least one textile yarn, comprising means for continuously moving at least one yarn taken off of a reel, a deposit head for depositing this yarn on a gas permeable conveyor belt, at least one thermotreatment enclosure traversed by the yarn resting freely on the conveyor belt, and an apparatus for taking up the yarn on the conveyor belt for rewinding it, said thermotreatment enclosure comprising an apparatus for drying the yarn by micro-wave treatment or high-frequencies provided with means for forced ventilation across the deposit of yarn and the conveyor belt, wherein said thermotreatment enclosure comprises a fixation zone provided with a tubular sheath which surrounds the conveyor belt and the yarn deposited thereon, this sheath having a double wall made up of a material permeable to the high frequencies or micro-waves utilized and enclosed in this double wall is a circuit of heating fluid, and a drying zone situated downstream of the fixation zone, and wherein the fixation zone and the drying zone are equipped with high-frequency or microwave generators.

2. The installation according to claim 1, wherein a deposit head is used for depositing the yarn in the form of turns or in any other repetitive geometry on the permeable conveyor belt.

3. The installation according to claim 1 wherein the thermotreatment container comprises at least one air inlet positioned on top of the conveyor belt, at least one air outlet situated beneath this conveyor connected to an aspiration means, and deflectors positioned between the edges of the conveyor and the lateral respective walls of the enclosure in a manner so as to force the air across the conveyor.

4. The installation according to claim 1 which comprises at least one water extraction apparatus positioned on the path of the yarn upstream of the deposit head.

5. The installation according to claim 4 wherein said water extraction apparatus is of the pneumatic expression type.

6. The installation according to claim 4, which comprises at least one means for impregnation of the yarn, positioned over the path of the yarn upstream of said water-extraction apparatus.

7. The installation according to claim 6, which comprises upstream of the deposit head an impregnation machine which contains impregnation means and the water-extraction apparatus.

8. The installation according to claim 7, wherein said impregnation means comprises a container containing a liquid through which extends the path of the yarn.

9. The installation according to claim 8, which comprises a pressurized vapor thermofixation chamber traversed by the conveyor belt between said thermotreatment enclosure and the yarn takeup apparatus.

10. A continuous drying process of textile yarns resting freely on a gas permeable conveyor belt, which comprises circulating said conveyor supporting the yarns across a washing or dyeing container maintained substantially at atmospheric pressure, exposing the yarns to microwaves or high frequencies causing a heating of the water contained in the yarns, while performing forced ventilation across the yarns and the conveyor belt, and wherein, in an initial zone of the path of the conveyor belt in the enclosure for heating the yarns, one suppresses the forced ventilation and one maintains an elevated humidity level around the yarns by means of a micro-wave or high frequencies permeable heated sheath, surrounding the conveyor and the yarns supported by it.

* * * * *